US006749088B1

(12) United States Patent
Holevas

(10) Patent No.: US 6,749,088 B1
(45) Date of Patent: Jun. 15, 2004

(54) TOOTHBRUSH WITH INTEGRATED WINDING KEY

(76) Inventor: Michael Holevas, 58-25 229th St., Bayside, NY (US) 11364

( * ) Notice: Subject to any disclaimer, the term of this patent is extended or adjusted under 35 U.S.C. 154(b) by 0 days.

(21) Appl. No.: 10/364,546

(22) Filed: Feb. 10, 2003

(51) Int. Cl.[7] ..... B65D 35/32

(52) U.S. Cl. ..... 222/99; 222/93; 222/333; 15/167.1; 132/311; 401/268

(58) Field of Search ..... 222/95, 93, 99, 222/100, 333; 15/167.1; 132/311; 401/268

(56) References Cited

U.S. PATENT DOCUMENTS

| | | | | | |
|---|---|---|---|---|---|
| 1,400,954 | A | * | 12/1921 | Burwell | 401/124 |
| 2,779,505 | A | * | 1/1957 | Sipmann | 222/100 |
| 2,875,458 | A | * | 3/1959 | Tsuda | 15/22.1 |
| 2,879,531 | A | * | 3/1959 | Hopkins | 401/123 |
| 2,930,064 | A | * | 3/1960 | Corbino | 401/155 |
| 5,322,193 | A | * | 6/1994 | Sunderland | 222/99 |
| 5,412,831 | A | * | 5/1995 | Mongelluzzo | 15/167.1 |
| 5,850,659 | A | * | 12/1998 | Butler et al. | 15/167.1 |
| 6,145,152 | A | * | 11/2000 | Ward | 15/176.1 |
| 6,401,977 | B1 | * | 6/2002 | Ross, III | 222/99 |

FOREIGN PATENT DOCUMENTS

| | | | | | |
|---|---|---|---|---|---|
| DE | 27 21 642 | A1 | | 11/1978 | |
| EP | 0 393 219 | A1 | * | 10/1990 | A46B/15/00 |
| GB | 2 044 089 | A | * | 11/1979 | |
| JP | 2001137044 | | | 5/2001 | |
| WO | WO 94/06323 | A1 | | 3/1994 | |
| WO | WO 98/37789 | | * | 9/1998 | A46B/9/04 |

* cited by examiner

*Primary Examiner*—Gregory L. Huson
*Assistant Examiner*—Melvin A. Cartagena
(74) *Attorney, Agent, or Firm*—Davidson, Davidson & Kappel, LLC

(57) ABSTRACT

A toothbrush with an extraction device, such as a key winding tool feature, built into the handle portion, which is used to facilitate the dispensing of toothpaste or the contents of other pasty substances found in collapsible tubes. One or more open-ended slits allow the handle portion to be easily slipped onto the free end of a tube or to be slipped back onto an already curled tube for further ease of manipulation. The toothbrush easily slips off the tube after curling with it, so as to allow the toothbrush to be used for brushing teeth, and allows its use on a plurality of collapsible tubes in various stages of use. The brush head portion can be made detachable so that other attachments made be attached to the handle portion or so that a winding tool remains after the toothbrush head is rendered no longer usable.

25 Claims, 4 Drawing Sheets

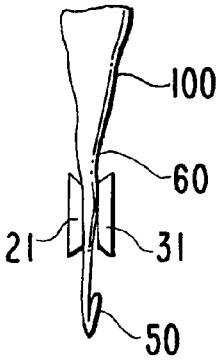
FIG.1A
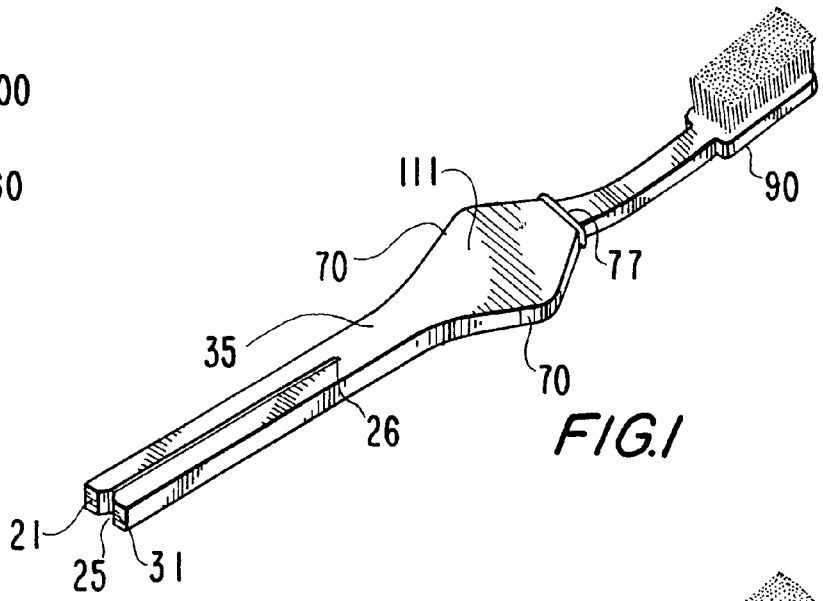
FIG.1
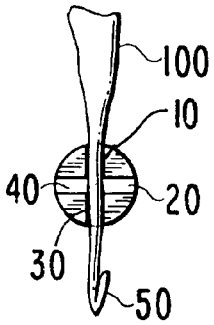
FIG.4A
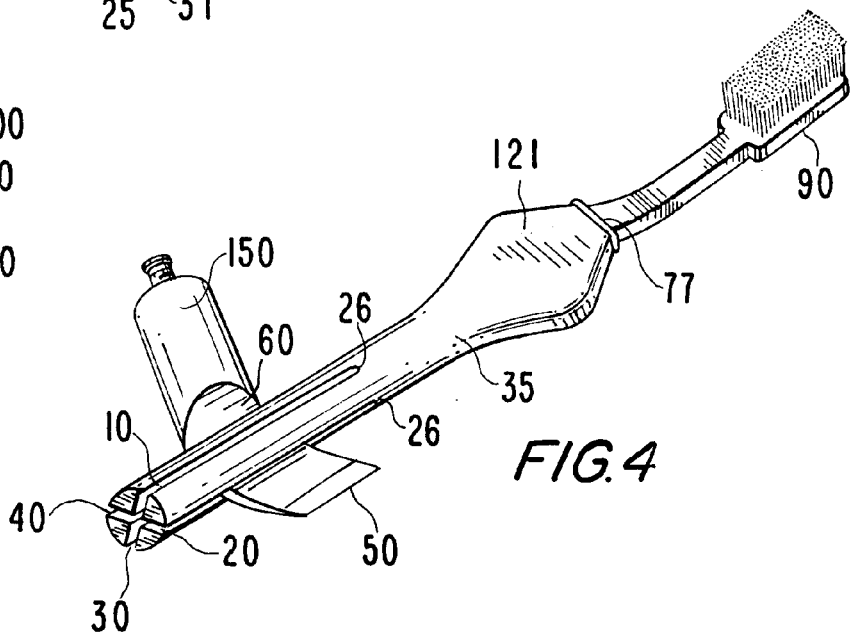
FIG.4
FIG.5A
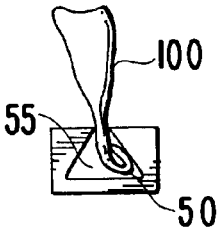
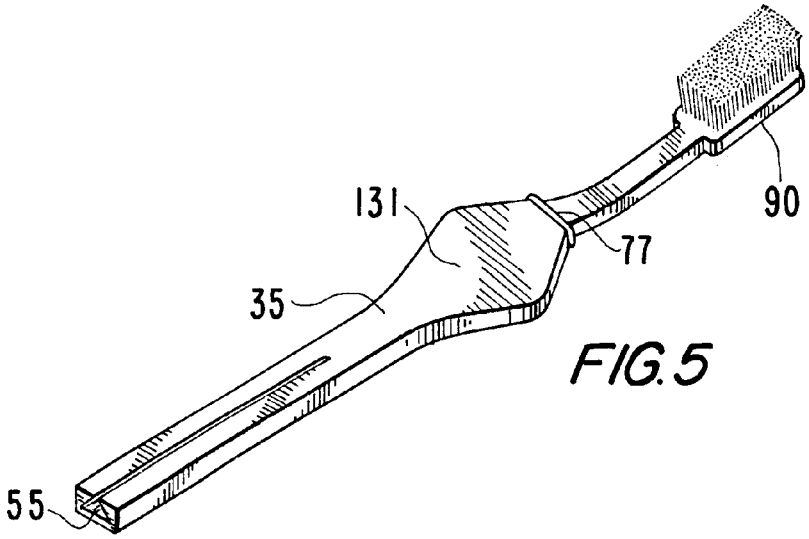
FIG.5

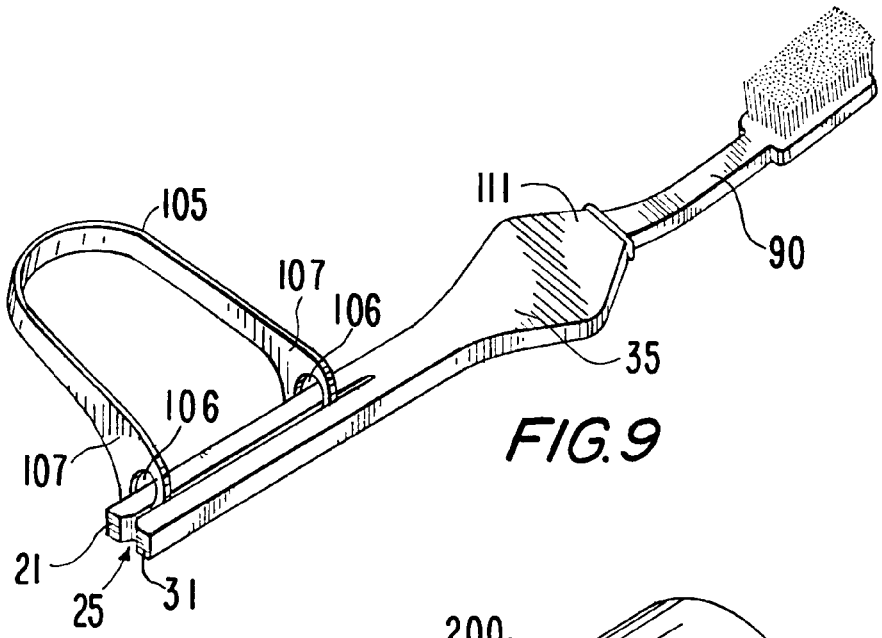
FIG. 9
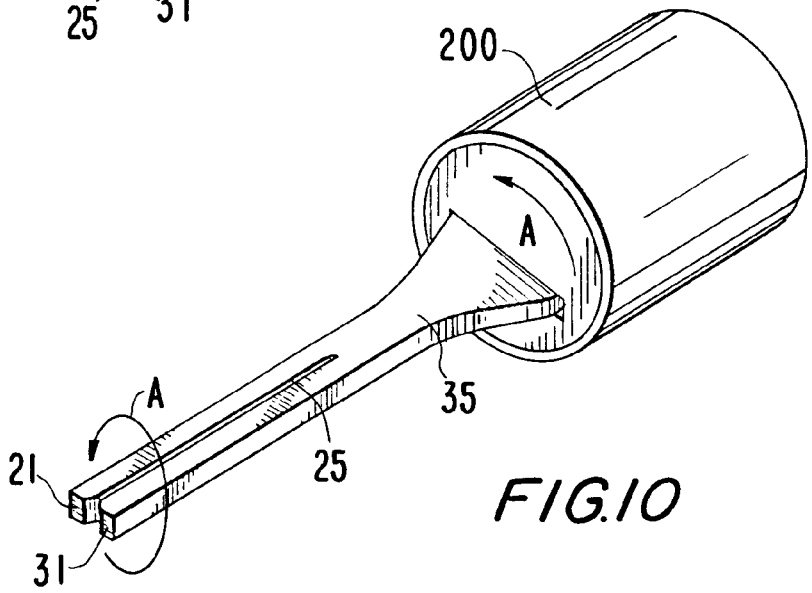
FIG. 10
FIG. 11
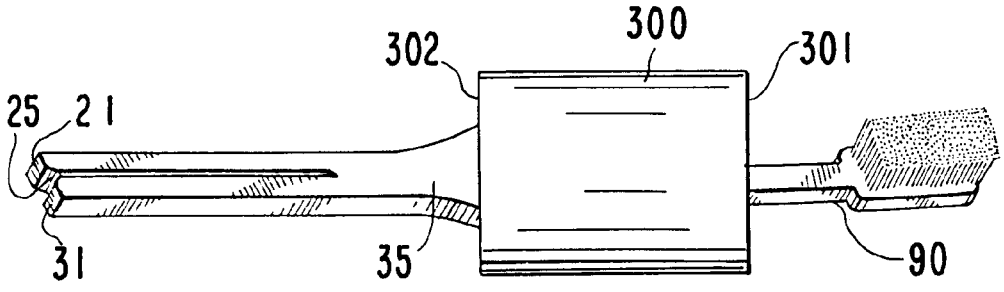

TOOTHBRUSH WITH INTEGRATED WINDING KEY

BACKGROUND OF THE INVENTION

1. Field of the Invention

The invention relates to a device for facilitating the dispensing of products found in collapsible tubes and the construction of a toothbrush with such a device integrated within it.

2. Prior Art

Collapsible tubes containing semi-fluid or pasty commodities such as toothpastes, creams, ointments, and the like, are dispensed by having a user forcefully exert pressure on the tube. However, the use of such a tube by the human hand alone results in the contents of the tube being dispensed unevenly, thereby leaving air pockets, and results in some of the contents of the tube being left behind, thereby resulting in some waste when one has finished dispensing the product in this fashion.

There have been many patented disclosures that are directed to facilitating dispensing product from a tube evenly and maximizing the expulsion of the contents of such tubes. For example, U.S. Pat. No. 2,670,876 to Clouse discloses some larger containers that house the tube entirely or partially with built in rollers or the like to evenly push the contents out of the tube from the bottom out. Although this might squeeze the contents of a tube out of the tube better than if done by free hand, it is a product that must be either mounted on a wall or stood on a table. A similar, table standing product, yet with fewer parts, is described in U.S. Pat. No. 5,215,223 to Lee. However, because of the size and the number and complexity of parts involved with these devices, these devices are much more complex to manufacture and result in a greater cost than some smaller and simpler inventions that serve the same purpose.

For example, smaller products include simple winding keys that a user places at the bottom of a collapsible tube and winds upward progressively, thereby exerting pressure to force the contents of the tube to the top of the tube. These devices, being made of fewer pieces, and in some instances only one piece, are simpler to manufacture, thereby also costing less. Some such devices are described in U.S. Pat. No. 1,257,609 to Johnson, U.S. Pat. No. 2,820,575 to Dietz, and U.S. Pat. No. 5,167,348 to Okami et al. The device shown in U.S. Pat. No. 1,257,609 to Johnson is most practical in that it is a simple one-piece key that is used to roll up the tube.

Regardless of which of these prior art devices a consumer uses, they all have the intent of neatly and effectively squeezing out the contents far better than a freehanded method. Thus, if every consumer would acquire and use such a dispensing tool, consumers would be able to dispense the contents of their tubes to the maximum, have more neatly wound up dispensing tubes and eliminate the waste from these collapsible containers. The use of the tool would also decrease any chance of puncturing more malleable tubes, such as those containing ointments, by being hand pushed.

However, even a device as simple as this and still as functional requires a cost to manufacture and a cost to the consumer. In addition, small winding tools could be misplaced, lost, even accidentally thrown out towards the end use of the tube's life, thus preventing capture of a good portion of the contents of the tube that is concealed within the tube in its final wound up stage.

SUMMARY OF THE INVENTION

Therefore, it is an object of the present invention to afford every consumer that has product within such collapsible tubes the opportunity to be able to use a winding tool for completely dispensing product from the tube without an additional cost to the consumer.

Since the most commonly found collapsible tube in one's household is a toothpaste tube, one would use a winding key, if available, most frequently on toothpaste tubes. Thus, the present invention comprises a winding tool built into the handle portion of a toothbrush, as will be described in preferred embodiments below.

Because a tube of toothpaste and a toothbrush go hand in hand, having a winding tool within the toothbrush would encourage one to use the tool for extracting toothpaste from the tube. Furthermore, a separate, additional item such as a winding key need not be acquired, nor need it take up any more space in one's drawer or other compartment. Having a winding tool on a toothbrush would enable the winding tool to be easily located for use on other tube-dispensed substances, since a toothbrush is generally used daily by consumers and not often misplaced.

It is a further purpose of this invention to have the winding key easily slip onto and off of a rolled up tube without the user having to uncurl the tube to start the expelling process again. This will enable one to use the toothbrush portion for brushing of teeth or to use the winding tool key portion on a plurality of tube like dispensers in various stages of use.

It is a further purpose of the invention for the user to have a winding key tool in his possession even after the user considers the toothbrush to which it is integrated no longer usable and discards it.

It is a further purpose of this invention to offer a winding key device with detachable and attachable accessories such as other brush heads, tooth picking utensil, string floss attachment, tongue scraper, etc. In addition, the user may simply use the winding key part of the toothbrush independently.

A new mold with my integrated design of the winding tool would not cost a manufacturer any more than the typical tooling cost for the conventional toothbrush. The option of acquiring a winding tool gratis with the purchase of a toothbrush can now be offered to the consumer, making such a toothbrush with an integrated winding tool more favorable over others with similar cost.

BRIEF DESCRIPTION OF THE DRAWINGS

Other objects, advantages, features and characteristics of the present invention, as well as methods, operation and functions, will become apparent upon consideration of the following detailed description, taken in conjunction with the accompanying drawings, in which similar reference characters refer to like parts throughout the several views and in which:

FIG. 1 shows a preferred embodiment of the toothbrush with an integrated winding key tool.

FIG. 1A shows a cross section of the bottom of the toothbrush handle of FIG. 1 with a side view of a collapsible tube through its slit.

FIG. 4 shows an embodiment of the device having more than one slit.

FIG. 4*a* shows a cross section of the bottom portion of the embodiment of FIG. 4 with a side view of a collapsible tube through one of its many slits.

FIG. 5 shows another embodiment of the device with a slit open only on one face of the handle.

FIG. 5*a* shows a cross section of the bottom portion of the embodiment of FIG. 5 with a side view of a collapsible tube where this type of slit is now only able to receive the end of a collapsible tube.

FIG. 9 shows the embodiment of FIG. 1 being used with a tongue scraper.

FIG. 10 shows the key handle portion being used with a motorized attachment.

FIG. 11 shows the key handle portion and the brush head portion both being used with a motorized attachment.

DETAILED DESCRIPTION OF THE PREFERRED EMBODIMENTS

Figure 3:
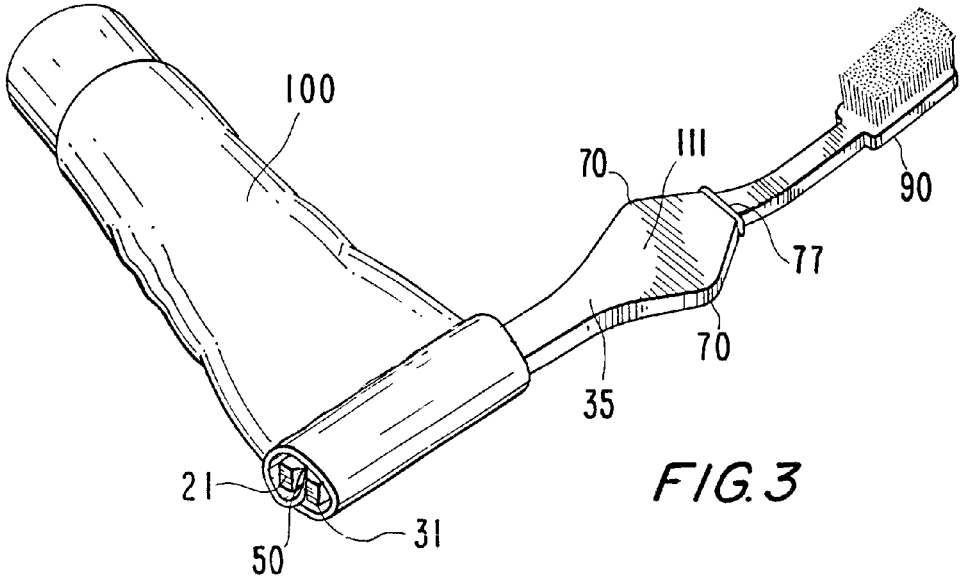
FIG. 3 shows a preferred embodiment of the toothbrush with integrated winding tool in use, being rolled up from the bottom portion of a somewhat used collapsible tube to the point where the contents of the tube have been forced upward.
Figure 2:
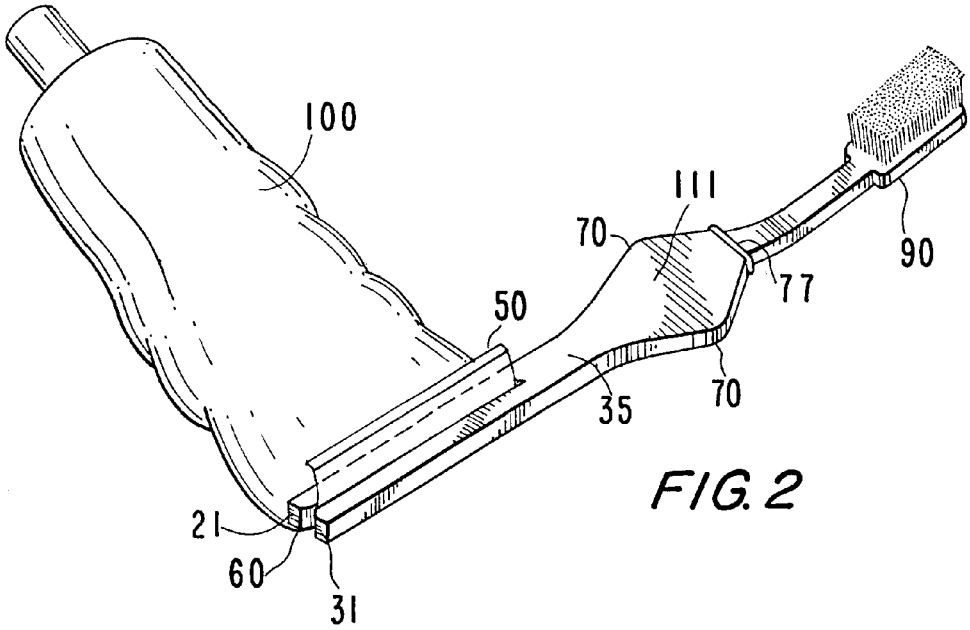
FIG. 2 shows a preferred embodiment of the device showing the toothbrush handle gripping the end or near the end of a collapsible tube.

Referring now in detail to the drawings and in particular, FIGS. 1–3 illustrate a preferred embodiment of the toothbrush with integrated winding key of the present invention. FIG. 1 illustrates toothbrush 111 with a head portion 90 and a handle portion 35. Handle portion 35 has a slit 25 longitudinally formed therein that begins at the end of the handle 35 and continues up handle 35 to a slit end point 26 that is at least partway up the handle 35 towards the head portion 90. In a preferred embodiment, slit 25 extends a majority of the way along handle 35, and extends at least as long as a several inches. Slit 25 separates the toothbrush handle portion 35 into two fingers 21, 31.

Toothbrush handle 35 is made of a sturdy and inexpensive material, preferably plastic. This material, of which conventional toothbrushes are made, is appropriate for the construction of the slit 25. Slit 25 can be formed into handle 35 during the molding process. Alternatively, handle 35 can be separated into fingers 21, 31 after the mold has set. The strong plastic and resilient properties of toothbrushes will also form resilient fingers 21, 31 that will keep them from moving or breaking during use of toothbrush 111 as a winding tool.

Slit 25 allows a collapsible tube 100 to be inserted between fingers 21, 31, as shown in FIG. 1A. Tube 100 typically has an opening at a top region and a free end at a bottom region. Tube 100 can be inserted into slit 25 either at its bottom-most point 50 at the free end or at other point 60 on tube 100, and can be inserted far enough into the slit 25 between fingers 21, 31 so as to be gripped across the entire width of tube 100, as shown in FIG. 2. FIG. 2 shows a preferred embodiment of the device showing the toothbrush handle gripping the end or near the end of a collapsible tube, wherein the open end slit design makes it easy for a slit 25 to be slipped onto an already used tube 100 at a mid-point 60 of the tube 100 other than the bottom 50. From this position, handle 35 could be slid upwards along tube 100 towards the aperture in order to forcibly expel the contents of tube 100. Alternatively, as discussed below and as shown in FIG. 3, handle 35 could be rolled with the free end of tube 100 towards the aperture in order to forcibly expel the contents of tube 100.

Handle portion 35 of toothbrush 111 also has shoulders 70 formed outward on its upper region to facilitate gripping of the handle portion 35 in its use as a winding tool. Turning the handle portion 35 with the fingers of a user's hand at shoulders 70, which could be formed in a wing design that extend outward, will enable use of the handle portion 35 of the toothbrush as a winding key. FIG. 3 shows a preferred embodiment of the toothbrush 111 in use, being rolled up from the bottom portion 50 of a somewhat used collapsible tube 100 to the point where the contents of the tube 100 have been forced upward, making it as easy to extract the contents of the tube 100 as if the tube 100 were new.

The toothbrush handle 35 is generally wider along its length than the prior art turning keys. This greater width will afford a greater ergonomic design to be built into the turning key portion and also offer better torque because of the fact that fingers 21, 31 are wider than the prior art turning keys. In addition, rather than having only a short slit at the end of the handle 35, a rather elongated slit can be made along the greater portion of the handle 35, thus allowing it to be used with many different tubes, from the widest to the narrowest. It is also preferred that fingers 21, 31 be kept parallel, up to the slit end point 26. This will allow the fingers 21, 31 to be freed and reinserted easily onto an already curled up tube, as shown for example in FIG. 3.

At the juncture between head portion 90 and handle portion 35, a ring 77 can be molded onto toothbrush 111, as shown in FIGS. 1–3. Ring 77 serves to act as a frangible or cutting point or can be made to allow head portion 90 to intentionally snap off handle portion 35, so as to separate the handle portion 35 from the brush head portion 90, thereby affording the user an independent winding key after the brush head 90 is rendered useless.

Referring to FIGS. 4 and 4A, another embodiment of the invention is illustrated wherein toothbrush 121 has a handle portion 35 into which multiple slits can be longitudinally formed. In this embodiment, two slits are orthogonally formed into handle 35, creating slit openings 10, 20, 30 and 40 in handle 35. FIGS. 4 and 4A show a collapsible tube 100 inserted through opposed slit openings 20 and 40. Of course, collapsible tube 100 could have easily been fitted through opposed slit openings 10 and 30. Similarly, other combinations of slit openings can also be used to grasp a collapsible tube 100, such as non-opposed slit openings 10 and 20 and non-opposed slit openings 30 and 40. The latter two combinations can be even used simultaneously with two separate tubes, by using the handle 35 as a winding key that holds and squeezes the two tubes concurrently, with one tube gripped within two adjoining slit openings and a second tube gripped within two other adjoining slit openings.

As shown in FIG. 4, a narrower tube 150 can be easily grasped anywhere within slits 10, 20, 30 and 40, between the end of handle 35 and the slit endpoints 26, and can be wound about, even at a point 60 on the tube far from the tube's bottom-most edge 50. Similarly, because of the length of the slits along handle 35 (in any embodiment of the invention described herein), more than one narrow tube 150 can be grasped within slits 10, 20, 30 and 40, for example two or more (not shown).

FIGS. 5 and 5A illustrate yet another embodiment of the invention wherein toothbrush 131 has a handle portion 35 into which a slit 55 that is open only on one side of handle 35 is formed. As shown in FIG. 5A, this design will allow only the very bottom 50 of collapsible tube 100 to be inserted into slit 55 to begin the winding process. Although the winding process of toothbrush 131 will work as well as that of toothbrushes 111 and 121 in FIGS. 1–3 and 4–4A, respectively, toothbrush 131 does not offer the user the ease of reinserting a tube within the slit easily as the others. In an already curled up tube, the bottom portion 50 has to be located within the curl to engage it back onto the slit 55 of toothbrush 131.

Figure 6:
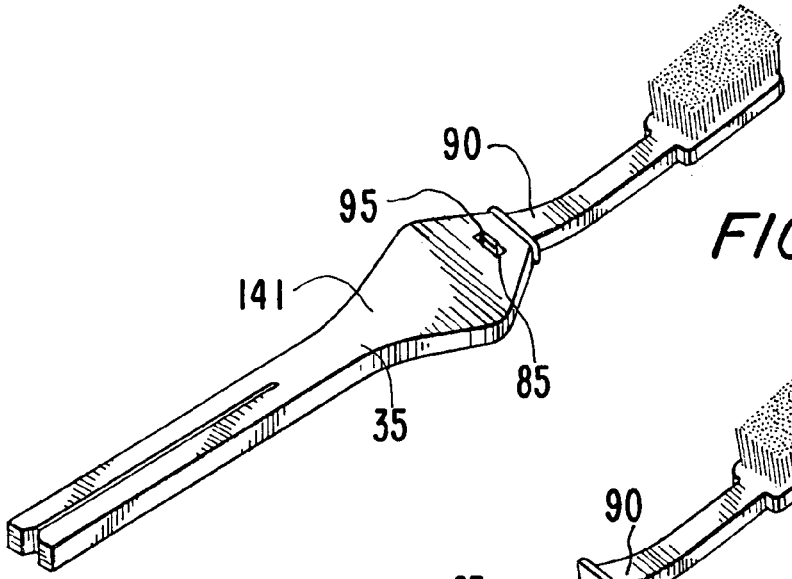
FIG. 6 shows an embodiment of the device made as a two-piece version.
Figure 7:
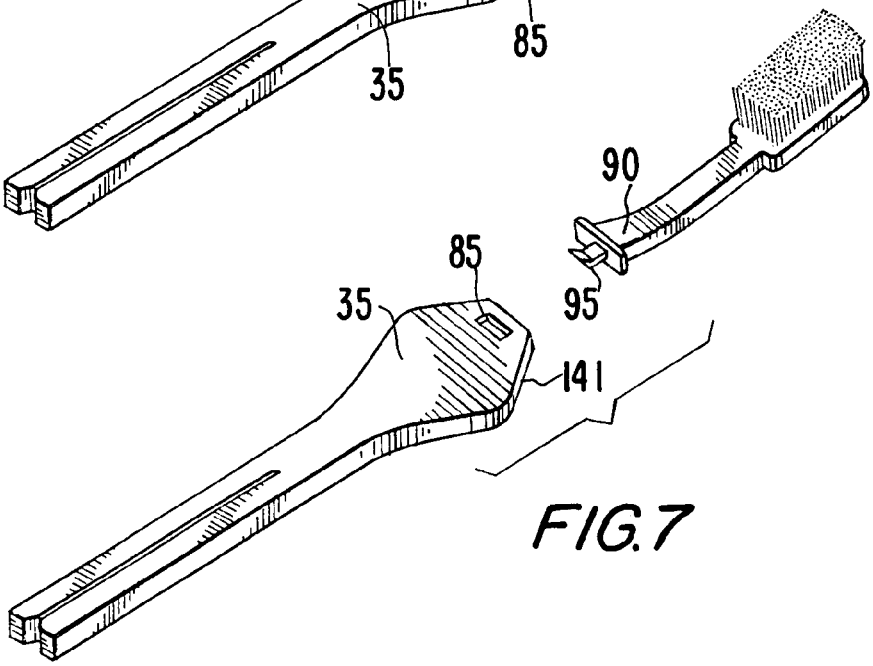
FIG. 7 shows the embodiment of FIG. 6 with the toothbrush head detached, such that another toothbrush head or accessory may replace it or such that the key portion may be left to function independently.

FIGS. 6–7 illustrate a two-piece version of the invention wherein the handle portion 35 and brush head portion 90 of toothbrush 141 are easily attachable and detachable from each other. In one embodiment, this attachment could be by means of one or more detent tabs and corresponding mating apertures. For example, as shown in FIGS. 6–7, one or more detent tabs 95 are attached to the inside end of brush head portion 90 and could be made to snap into a corresponding number of mating holes or ports 85 within the head end portion of handle 35. This attachment mechanism could also be made as a threaded-screw type of mechanism, wherein the handle 35 and head 90 portions of toothbrush 141 screw into each other.

As shown in FIGS. 6–7, a two-piece design would allow the possibility of having accessory head attachments, such as other types of brush heads, cleaning pick utensil, floss head attachment, etc., that can be easily attached to and removed from the handle portion 35. Perhaps, as a result, the future cost of toothbrushes may even be less expensive in this arrangement, since less material is used in the brush head attachment piece 90, and a brush head attachment piece 90 would be all one would need to purchase after the initial investment in the handle portion 35, which remains for use as a winding key.

Figure 8:
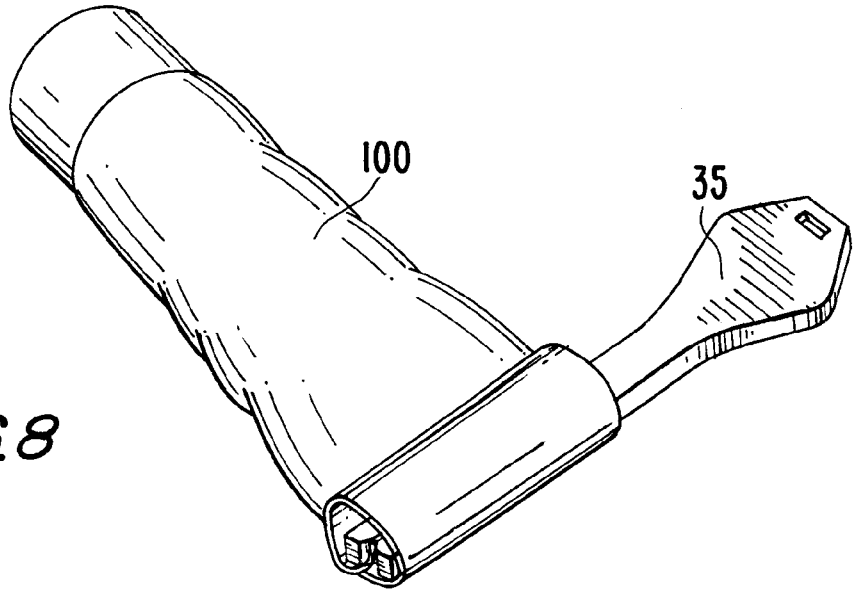
FIG. 8 shows the key handle portion of the embodiment of FIG. 6 being used independently on a collapsible tube.

As illustrated in FIG. 8, handle portion 35 is shown in use as a winding key tool independent of a toothbrush head 90 or other attachment. This could have resulted from handle portion 35 being detached from the brush head 90 or from another accessory attachment, or could be the end result of toothbrush 111 after it has been permanently detached at point 77.

It should be noted that the toothbrush with integrated winding key tool of the present invention can be used with other related structures. For example, the winding key portion can also be applied like many automated toothbrushes that are powered by batteries and that usually perform mechanical movement with the brushes. Likewise, the same battery power can also be used to transfer energy to a mechanical motor attached to the winding key portion. This would now enable one to eliminate the step of manually winding the key after fitting it onto a tube, while still achieving the same goal of extracting the contents of the tube. In this situation, as illustrated in FIG. 10, the detached handle portion 35 would be adapted to mate with a mechanized motor attachment 200 to perform the winding motion that would otherwise be performed by the user. The mating of handle 35 and attachment 200 could be done by any means known in the art. The user could grip attachment 200 and the motor contained within attachment 200 would cause handle 35 to rotate, for example in the direction of arrow A, causing fingers 21, 31 to be rotated in the direction of arrow A, thus winding a tube that is gripped within slit 25. This would be especially helpful for those with finger or hand ailments to be able to utilize the winding tool and maximize the extraction of materials from tubes.

Similarly, a mechanized toothbrush could have both the brush head and the winding key handle portion be mechanized. For example, an automated toothbrush would normally have a motor situated in the handle portion of the toothbrush for mechanical movement of the brush head. In this embodiment, as shown in FIG. 11, the toothbrush could have a motorized midsection 300 situated between the brush head portion 90 and the handle portion 35, which midsection 300 would be equipped with the winding key structures described above, such as fingers 21, 31 and slit 25. The midsection 300 would preferably have a motorized mechanism within that would be attached on one end 301 to the brush head 90 for mechanized tooth-brushing movement and would be attached on the other end 302 to the handle 35 for mechanized extraction of a tube's contents. Of course, it is preferred that, because the motorized motions would be different for the brush 90 and handle 35, with that of the brush 90 being vibration for brushing of teeth and that of the handle 35 being rotation for winding of the toothpaste tube, the midsection 300 would contain separate motors for each end 301, 302. In a preferred embodiment, the handle 90 and brush 35 ends could be detachable from the motorized midsection 300, and the mating of brush head 90 handle 35 with midsection 300 could be done by any means known in the art.

Another feature of the device is that a tongue scraper, such as of the type described in U.S. Pat. No. 1,893,524 to Shanley and U.S. Pat. No. 5,217,475 to Kuber, can be attached. A tongue scraper having end or grip portions, such as in Shanley, can be fitted onto handle portion 35 of toothbrush 111 or 121, as shown in FIG. 9. The tongue scraper 105 can be modified to have apertures or holes 106 in grip portions 107 rather than just indentations, as in the Shanley patent, so that these holes 106 can be slipped over handle 35 or over one of fingers 21, 31 and gripped within slit 25 when the tongue scraper 105 is being used. Alternatively, tongue scraper 105 could have other gripping means, such as a flap that wraps around handle 35, or one of fingers 21, 31, with a tab extension that is inserted into a hole in the flap, thereby gripping handle 35 or one of fingers 21, 31. Of course, tongue scraper 105 could be used with any of the toothbrush embodiments disclosed herein.

The above illustrations were designed for illustration only and not to define the limits of the invention, and it is to be understood that other embodiments may be utilized without departing from the spirit or scope of the invention.

What is claimed is:

1. A toothbrush comprising a handle portion and a brush head portion, said handle portion comprising an integrated extraction device, wherein said extraction device comprises at least one slit formed through said handle portion, said at least one slit longitudinally extending at least partway along said handle portion beginning at its distal end and being wide enough to fit a free end of a tube within said slit, said at least one slit having sufficient width to allow a midpoint of an extended or partially rolled tube to be gripped by a slit of said extraction device and moved towards an aperture of the tube, either by sliding said extraction device along the tube or by winding said extraction device towards the aperture, for extracting the contents of the tube, wherein said handle portion is removably attached to said brush head portion such that said handle portion may be detached from said brush head portion and may be used as an extraction device independent of said brush head portion and may be reattached to said brush head portion for use as a toothbrush.

2. The toothbrush of claim 1 wherein said at least one slit is formed into and extends completely through said handle portion.

3. The toothbrush of claim 2 wherein said extraction device comprises two slits formed into and extending completely through said handle portion, said two slits intersecting longitudinally within said handle portion.

4. The toothbrush of claim 1 wherein said handle portion comprises finger grip regions for use by a user in manipulating said handle portion for extracting the contents of the tube.

5. The toothbrush in claim 4 wherein said finger grip regions comprise shoulders that are formed outward on said handle portion to facilitate gripping of said handle portion and manipulation of said extraction device.

6. The toothbrush of claim 1 wherein said handle portion, once it is detached from said brush head portion, is able to be attached to other brush head portions or accessory attachments.

7. The toothbrush of claim 1 wherein said handle portion is removably attached to said brush head portion by a threaded attachment.

8. The toothbrush of claim 1 wherein said handle portion is removably attached to said brush head portion by at least one detent tab and at least one corresponding mating aperture.

9. The toothbrush of claim 1, further comprising an attached tongue scraper, said tongue scraper comprising a thin, narrow strip of flexible resilient material with gripping means at the ends, whereby said gripping means are gripped by the handle portion.

10. A toothbrush comprising a handle portion and a brush head portion, said handle portion comprising an integrated extraction device, wherein said extraction device comprises at least one slit formed through said handle portion, said at least one slit longitudinally extending at least partway along said handle portion beginning at its distal end and being wide enough to fit a free end of a tube within said slit, said at least one slit having sufficient width to allow a midpoint of an extended or partially rolled tube to be gripped by a slit of said extraction device and moved towards an aperture of the tube, either by sliding said extraction device along the tube or by winding said extraction device towards the aperture, for extracting the contents of the tube, further comprising an attached tongue scraper, said tongue scraper comprising a thin, narrow strip of flexible resilient material with gripping means at the ends, whereby said gripping means are gripped by a portion of said handle portion split by said slit.

11. A toothbrush comprising a handle portion and a brush head portion, said handle portion comprising at least one slit formed into said handle portion and extending longitudinally at least partway along said handle portion beginning at its distal end and being wide enough to fit a free end of a tube within said slit, whereby said free end of a tube may be gripped by said handle portion and moved towards an aperture of the tube, either by sliding said handle portion along the tube or by winding said handle portion towards the aperture, for extracting the contents of the tube, said handle portion being removably attached to said brush head portion such that said handle portion, once it is detached from said brush head portion, is able to be attached to a mechanized device to manipulate it non-manually to extract the contents of the tube.

12. The toothbrush of claim 11 wherein said handle portion is removably attached to said brush head portion by a threaded attachment.

13. The toothbrush of claim 11 wherein said handle portion is removably attached to said brush head portion by at least one detent tab and at least one corresponding mating aperture.

14. A toothbrush comprising a handle portion, a brush head portion and a midsection situated between said handle portion and said brush head portion, said handle portion comprising at least one slit formed into said handle portion and extending longitudinally at least partway along said handle portion beginning at its distal end and being wide enough to fit a free end of a tube within said slit, whereby said free end of a tube may be gripped by said handle portion and moved towards an aperture of the tube, either by sliding said handle portion along the tube or by winding said handle portion towards the aperture, for extracting the contents of the tube, said midsection having a first end and a second end and having a motorized mechanism within said midsection, said midsection first end being attached to said brush head portion for mechanized tooth-brushing movement of said brush head portion, and said midsection second end being attached to said handle portion for mechanized extraction movement of said handle portion to extract the contents of the tube.

15. The toothbrush of claim 14 wherein either or both of the brush head portion and the handle portion are removably attached to the respective end of said midsection.

16. A utility toothbrush comprising a handle portion and a brush head portion, said handle portion comprising an integrated extraction device, said extraction device comprising at least one slit formed into said handle portion and extending longitudinally at least partway along said handle portion beginning at its distal end and being wide enough to fit a free end of a tube within said slit, whereby said free end of the tube may be gripped by said extraction device and moved towards an aperture of the tube, either by sliding said extraction device along the tube or by winding the free end of said extraction device towards the aperture, for extracting the contents of the tube, and a tongue scraper for attachment to said toothbrush, said tongue scraper comprising a strip of flexible resilient material with gripping means at the ends adapted to be gripped by a portion of said handle portion split by said slit, such that said tongue scraper is gripped by said extraction device and is prevented from rotating relative to said toothbrush, wherein said handle portion is removably attached to said brush head portion such that said handle portion may be detached from said brush head portion and may be used as an extraction device independent of said brush head portion and may be reattached to said brush head portion for use as a toothbrush.

17. A multi use toothbrush, comprising;

a brush head portion; and a handle portion with an open end slit starting from a distal end of said handle portion and longitudinally extending at least partway along said handle portion, said open end slit providing a means to grasp a tube at any point desired, to either slide along a tube towards an opening or to wind the tube towards an opening in order to extract the contents forward of the point at which grasped, said open end slit serving as a means for attaching ends of a flexible tongue scraper, wherein said handle portion is removably attached to said brush head portion such that said handle portion may be detached from said brush head portion and may be used as an extraction device independent of said brush head portion and may be reattached to said brush head portion for use as a toothbrush.

18. The toothbrush of claim 17 comprising a plurality of said open end slits on said handle portion.

19. The toothbrush of claim 18 wherein the plurality of open end slits on said handle comprise at least one open end slit extending completely through said handle and at least one open end slit extending partially through said handle.

20. The toothbrush of claim 17 wherein said open end slit is formed only partially through said handle.

21. The toothbrush of claim 17 wherein said open end slit is formed completely through said handle.

22. The toothbrush of claim 17 further including finger grip regions on an upper region of said handle portion for manipulating said handle portion while engaged in toothpaste tube contents extraction or tongue scraping activity.

23. The toothbrush of claim 17 wherein said handle portion, once detached from said brush head portion, is able to be used as a toothpaste extraction tool or as a tool for use with flexible tongue scrapers.

24. The toothbrush of claim 23 wherein said handle portion, once it is detached from said brush head portion and used as a toothpaste extraction tool or as a tool for use with flexible tongue scrapers, may be reattached to said brush head portion.

25. A multi use toothbrush, comprising:

a brush head portion; and a handle portion with an open end slit starting from a distal end of said handle portion and longitudinally extending at least partway along said handle portion, said open end slit providing a means to grasp a tube at any point desired, to either slide along a tube towards an opening or to wind the tube towards an opening in order to extract the contents forward of the point at which grasped, and serving as a means for attaching ends of a flexible tongue scraper, and a motorized mechanism to enhance the manipulation of said handle portion while it is engaged in tube contents extraction or tongue scraping activity.

* * * * *